US010597763B2

(12) United States Patent
Li et al.

(10) Patent No.: US 10,597,763 B2
(45) Date of Patent: Mar. 24, 2020

(54) IN-BATH ROLL AND METHOD FOR PRODUCING IN-BATH ROLL

(71) Applicant: NIPPON STEEL & SUMIKIN HARDFACING CO., LTD., Tokyo (JP)

(72) Inventors: Yu Li, Tokyo (JP); Kazuaki Oda, Tokyo (JP); Kodai Kawano, Tokyo (JP); Koichi Shijo, Tokyo (JP)

(73) Assignee: NIPPON STEEL & SUMIKIN HARDFACING CO., LTD., Tokyo (JP)

( * ) Notice: Subject to any disclaimer, the term of this patent is extended or adjusted under 35 U.S.C. 154(b) by 0 days.

(21) Appl. No.: 16/306,394

(22) PCT Filed: Oct. 20, 2017

(86) PCT No.: PCT/JP2017/038041
§ 371 (c)(1),
(2) Date: Nov. 30, 2018

(87) PCT Pub. No.: WO2019/077748
PCT Pub. Date: Apr. 25, 2019

(65) Prior Publication Data

US 2019/0360084 A1 Nov. 28, 2019

(51) Int. Cl.
*C23C 2/00* (2006.01)
*C23C 4/067* (2016.01)
(Continued)

(52) U.S. Cl.
CPC ..... *C23C 2/003* (2013.01); *C23C 2/12* (2013.01); *C23C 2/40* (2013.01); *C23C 4/067* (2016.01);
(Continued)

(58) Field of Classification Search
CPC ..... C23C 2/003; C23C 2/067; C23C 2/129; C23C 2/134; C23C 2/12; C23C 2/40; C23C 2/10
(Continued)

(56) References Cited

U.S. PATENT DOCUMENTS 5,395,661 A * 3/1995 Mizunuma ..... C23C 2/003 427/226
5,711,613 A 1/1998 Ookouchi et al.
(Continued)

FOREIGN PATENT DOCUMENTS

JP H06-330278 A 11/1994
JP H07-279968 A 10/1995
(Continued)

OTHER PUBLICATIONS

English Translation of JP 200144364 A retrieved from Espace.net on Oct. 21, 2019 (Year: 2000).*
(Continued)

*Primary Examiner* — Jason L Vaughan
(74) *Attorney, Agent, or Firm* — Manabu Kanesaka

(57) ABSTRACT

The in-bath roll used in a metal bath containing Al includes: an undercoat layer formed on a roll surface, the undercoat layer being formed by a cermet thermal spray coating film containing a first boride containing at least WB, WCoB, $W_2CoB_2$, a second boride composed of at least one kind of Cr, Zr, and Ti borides, and a balance composed of a cobalt-based alloy not containing nickel of 5% by mass or more; a topcoat layer formed on a surface of the undercoat layer, the topcoat layer being formed by a ceramic thermal spray coating film containing at least $ZrO_2$ and $Y_2O_3$; and a friction reducing layer formed on a surface of the topcoat layer, the friction reducing layer being composed of BN and at least one kind of $TiO_2$, $ZrO_2$, $SiO_2$, MgO, and CaO.

9 Claims, 3 Drawing Sheets

(51) Int. Cl.

| | |
|---|---|
| ***C23C 4/129*** | (2016.01) |
| ***C23C 4/134*** | (2016.01) |
| ***C23C 2/12*** | (2006.01) |
| ***C23C 2/40*** | (2006.01) |
| ***C23C 4/10*** | (2016.01) |

(52) U.S. Cl.
CPC ..... *C23C 4/10* (2013.01); *C23C 4/129* (2016.01); *C23C 4/134* (2016.01)

(58) Field of Classification Search
USPC ..... 492/17, 54, 58
See application file for complete search history.

(56) References Cited

U.S. PATENT DOCUMENTS 5,763,107 A * 6/1998 Rickerby ..... C23C 14/083 428/623
6,419,615 B1 * 7/2002 Chen ..... G03G 15/2057 492/53
6,572,518 B1 * 6/2003 Midorikawa ..... C23C 4/06 29/895.32
9,422,617 B2 * 8/2016 Li ..... C23C 4/06
2015/0322558 A1 * 11/2015 Li ..... C23C 4/06 428/457

FOREIGN PATENT DOCUMENTS

| | | | |
|---|---|---|---|
| JP | 2000-054095 | A | 2/2000 |
| JP | 2000-144358 | A | 5/2000 |
| JP | 2000-144364 | A | 5/2000 |
| JP | 4571250 | B2 | 10/2010 |

OTHER PUBLICATIONS

PCT/ISA/210, "International Search Report for International Application No. PCT/JP2017/038041," dated Nov. 21, 2017.
PCT/ISA/237, "Written Opinion of the International Searching Authority for International Application No. PCT/JP2017/038041," dated Nov. 21, 2017.

* cited by examiner

IN-BATH ROLL AND METHOD FOR PRODUCING IN-BATH ROLL

RELATED APPLICATIONS

The present application is National Phase of International Application No. PCT/JP2017/038041 filed Oct. 20, 2017, the disclosure of which is hereby incorporated by reference herein in its entirety.

TECHNICAL FIELD

The present invention relates to a technique for modifying the surface of an in-bath roll used in a molten aluminum bath.

BACKGROUND ART

As a method for forming a plating film on the surface of a steel plate, a method of immersing the steel plate in a pot containing molten aluminum is known. The pot is provided with rolls in a molten metal bath (for example, a sink roll, a support roll) in order to perform continuous plating of a steel plate. A protective layer having resistance to molten metal reaction and resistance to corrosion and abrasion is formed on the surface of the roll.

Patent Literature 1 discloses a powder composition having resistance to molten metal reaction, characterized in that an undercoat layer is formed on the surface of a roll in a molten metal bath and a specific layer is formed on the undercoat layer, where the specific layer is composed of $ZrO_2$.x (x is an oxide selected from the group consisting of CaO, $Y_2O_3$, MgO, $CeO_2$, and $HfO_2$) and $ZrSiO_4$ and/or its decomposition product ($ZrO_2$ and $SiO_2$) of which attachment state has been confirmed by X-ray phase analysis. Patent Literature 1 further discloses an undercoat layer composed of one or more ceramic components among metal carbides (WC, TiC, $Cr_3C_2$, NbC, ZrC, TaC, MoC, and VC), metal borides ($CrB_2$, $TiB_2$, $ZrB_2$, and $MoB_2$), and metal nitrides (MoN and TiN), and one or more of Co, Ni, Cr, Mo, and W.

Patent Literature 2 discloses that an aqueous solution or slurry of any one or more selected from oxides, borides, and nitrides is applied to the surface of an oxide-based ceramic thermal spray coating film and the inside of pores in the coating film to perform a pore-sealing treatment. Furthermore, in paragraph 0026 of the specification of Patent Literature 2, there is disclosed a pore-sealing technique in which an oxide such as $TiO_2$, $ZrO_2$, $SiO_2$, or MgO, or a nitride such as BN is added to an aqueous solution of chromic anhydride, ammonium chromate, or ammonium dichromate, and the resultant solution is applied to a thermal spray coating film and is heated and fired.

CITATION LIST

Patent Literature

Patent Literature 1: JPH6-330278
Patent Literature 2: JP4571250

SUMMARY OF INVENTION

Technical Problem

The in-bath roll having the configuration of Patent Literature 1 was used in a molten aluminum bath, but the corrosion resistance to molten aluminum, high-temperature oxidation resistance, and abrasion resistance were not sufficient.

In particular, in recent years the rotational speeds of the support roll and the sink roll are controlled to be lower than the line speed of the steel sheet in many cases, so that the support roll and the sink roll are exposed to a severe abrasion environment. For this reason, there is a strong demand for improvement in abrasion resistance imparted to these rolls.

Solution to Problem

In order to solve the aforementioned problems, an in-bath roll according to the invention of this application is (1) an in-bath roll used in a metal bath containing at least 50% by mass or more of Al, the in-bath roll including: an undercoat layer formed on the surface of the roll, the undercoat layer being formed by a cermet thermal spray coating film containing a first boride containing at least WB, WCoB, $W_2CoB_2$, a second boride composed of at least one kind of Cr, Zr, and Ti borides, and a balance composed of a cobalt-based alloy not containing nickel of 5% by mass or more; a topcoat layer formed on the surface of the undercoat layer, the topcoat layer being formed by a ceramic thermal spray coating film containing at least $ZrO_2$ and $Y_2O_3$; and a friction reducing layer formed on the surface of the topcoat layer, the friction reducing layer being composed of BN and at least one kind of $TiO_2$, $ZrO_2$, $SiO_2$, MgO, and CaO, wherein, with respect to 100% by mass of the cermet thermal spray coating film, the first boride is 55% by mass or more and 75% by mass or less, the second boride is 5% by mass or more and 15% by mass or less, and the content of B is 5.0% by mass or more and 7.0% by mass or less, and BN is contained in an amount of 20% by mass or more with respect to 100% by mass of the friction reducing layer.

(2) The in-bath roll described in (1) above, characterized in that, with respect to 100% by mass of the cermet thermal spray coating film, the content of the first boride is 64% by mass or more and 70% by mass or less and the content of the second boride is 7% by mass or more and 12% by mass or less.

(3) The in-bath roll described in (1) or (2) above, characterized in that, with respect to 100% by mass of the ceramic thermal spray coating film, $Y_2O_3$ is contained in an amount of 6% by mass or more and 12% by mass or less.

(4) The in-bath roll described in any one of (1) to (3) above, characterized in that the ceramic thermal spray coating film further contains at least one kind of CaO, $Al_2O_3$, $SiO_2$, and MgO.

(5) A method for producing the in-bath roll described in (1) above, characterized by forming the cermet thermal spray coating film by a high velocity flame spraying method, and forming the ceramic thermal spray coating film by a plasma spraying method.

The method for producing the in-bath roll described in (5) above, characterized in that the friction reducing layer is formed by coating the topcoat layer with water containing BN and at least one kind of $TiO_2$, $ZrO_2$, $SiO_2$, MgO, and CaO, followed by firing.

Advantageous Effects of Invention

According to the invention of this application, there can be provided an in-bath roll excellent in corrosion resistance against molten aluminum, high-temperature oxidation resistance, and abrasion resistance.

DESCRIPTION OF EMBODIMENTS

Figure 1:
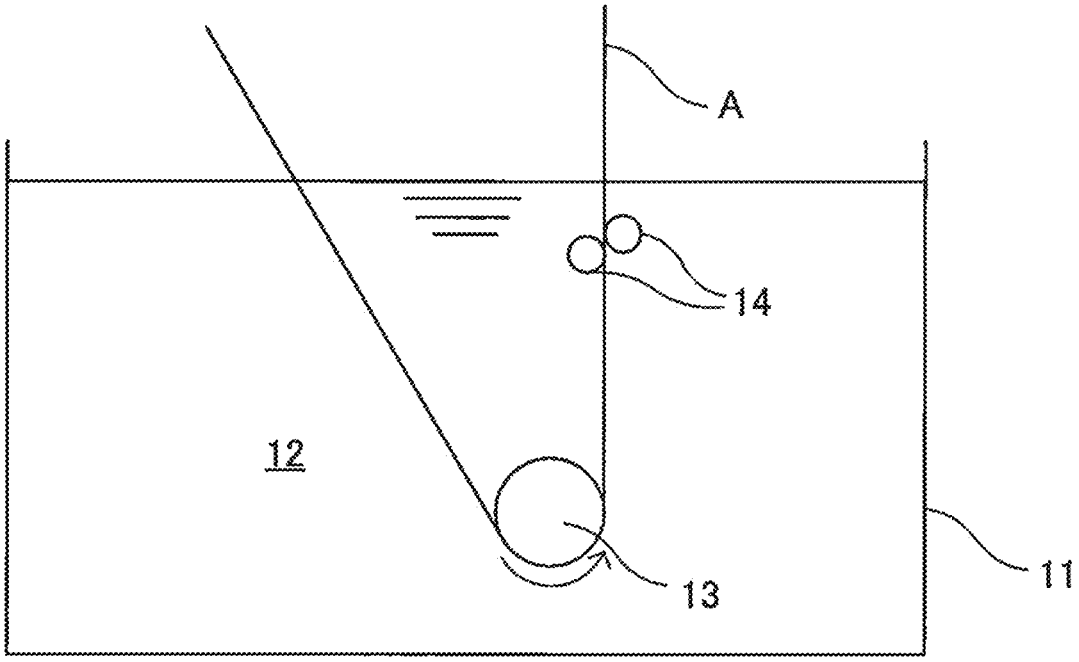
FIG. 1 is a schematic diagram illustrating a schematic configuration of a hot-dip aluminum plating apparatus.

FIG. 1 shows a schematic configuration of a hot-dip aluminum plating apparatus. The hot-dip aluminum plating apparatus includes a pot 11, a sink roll 13, and a support roll 14. A metal bath 12 is stored in the pot 11. The metal bath 12 is molten metal including aluminum as a main component, and contains zinc and the like in addition to aluminum. Aluminum is contained in the metal bath 12 in an amount of at least 50% by mass. The sink roll 13 is disposed in the metal bath 12 and changes the conveying direction of a steel sheet A. The support roll 14 is provided at a position where the steel sheet A is held. The support roll 14 stabilizes the passing position of the steel sheet A and equalizes the thickness of the plated matter.

After the steel sheet A is immersed in the metal bath 12, the direction of the steel sheet A is changed by the sink roll 13. After the thickness of the plated matter is leveled by the support roll 14, the steel sheet A is conveyed to the outside of the pot 11.

Figure 2:
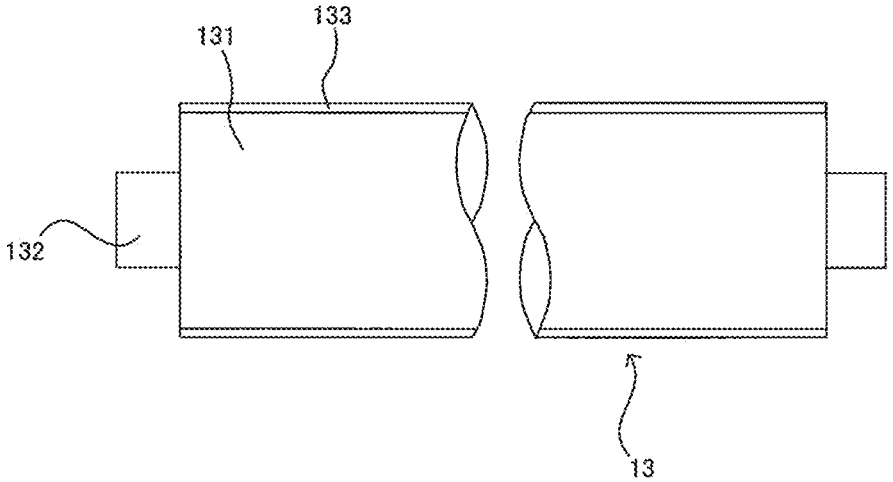
FIG. 2 is a schematic enlarged view of a portion of a sink roll.
Figure 3:
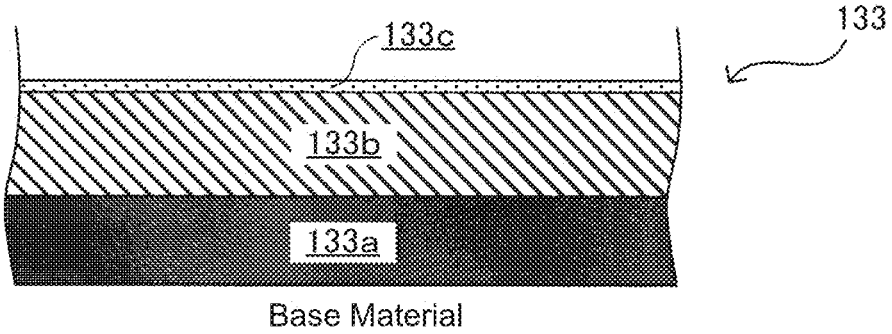
FIG. 3 is a cross-sectional view of a portion of a protective layer.

A detailed description will next be given of a protective layer formed on the surface of the sink roll 13 with reference to FIGS. 2 and 3. FIG. 2 is a schematic cross-sectional view of a portion of the sink roll 13. FIG. 3 is a cross-sectional view of a portion of the protective layer.

The sink roll 13 includes a roll body portion 131, roll shaft portions 132 formed at respective ends of the roll body portion 131, and a protective layer 133 formed on the surface of the base material of the roll body portion 131. The roll shaft portions 132 are rotatably supported by a not-illustrated bearing portion. The steel plate A can be conveyed in and out of the metal bath 12 by rotating the sink roll 13 in the arrow direction (see FIG. 1) with the roll shaft portion 132 as the rotation axis.

The protective layer 133 includes an undercoat layer 133*a*, a topcoat layer 133*b*, and a friction reducing layer 133*c*. When the sink roll 13 is immersed in the metal bath 12, the sink roll 13 thermally expands to generate cracks in the topcoat layer 133*b* formed on the undercoat layer 133*a*. Since the molten metal in the metal bath 12 reaches the undercoat layer 133*a* through the crack, the undercoat layer 133*a* is required to have corrosion resistance to molten aluminum and high-temperature oxidation resistance.

(Undercoat Layer 133*a*)

The undercoat layer 133*a* is a cermet thermal spray coating film, and is composed of a first boride, a second boride, and a Co-based alloy. As the first boride, W boride composed of WB, WCoB, and $W_2CoB_2$ is used. The W boride may contain W boride composed of W, Cr, and B. At least one kind of Cr boride, Zr boride, and Ti boride is used in the second boride. Since at least one kind of them is used, one kind of Cr boride, Zr boride, and Ti boride may be used to constitute the second boride. Two kinds of Cr boride, Zr boride, and Ti boride may be used to constitute the second boride. Three kinds of Cr boride, Zr boride, and Ti boride may be used to constitute the second boride. Among these, a first thermal spray coating film composed of W boride, Zr boride, and a Co-based alloy is particularly suitable.

The present inventors have found that, when the first thermal spray coating film contains the first boride and the second boride in specific ratios high-temperature oxidation resistance can be imparted thereto while corrosion by molten aluminum to the base material is prevented. That is, the present inventors have found that the corrosion resistance against molten aluminum and the high-temperature oxidation resistance are remarkably enhanced. Here, the high-temperature oxidation resistance includes oxidation resistance of the base material as well as oxidation resistance of the undercoat layer 133*a* itself. In other words, when the first thermal spray coating film contains the first boride and the second boride in the specific ratios, the high-temperature oxidation resistance of both the undercoat layer 133*a* and the base material can be tremendously enhanced.

A description will next be given of the specific ratios. With respect to 100% by mass of the first thermal spray coating film, the first boride is 55% by mass or more and 75% by mass or less and the second boride is 5% by mass or more and 15% by mass or less. Preferably, the first boride is 64% by mass or more and 70% by mass or less and the second boride is 7% by mass or more and 12% by mass or less. The thermal spray coating film may include amorphous non-crystalline phases of any of the first boride and the second boride by quenching after thermal spraying.

If the content of the first boride is lowered to be less than 55% by mass, the high-temperature oxidation resistance and the molten aluminum corrosion resistance become insufficient. If the content of the first boride exceeds 75% by mass, the content of B in the thermal spray coating film may become less than 5.0% by mass, so that the molten aluminum corrosion resistance and the high-temperature oxidation resistance of the thermal spray coating film may become insufficient. That is, if the content of the first boride exceeds 75% by mass, the thermal spray coating film becomes a W-rich coating film, and the content of B is reduced. Thus, the molten aluminum corrosion resistance of the thermal spray coating film may become insufficient.

If the content of the second boride is lowered to be less than 5% by mass, the content of B in the thermal spray coating film may be less than 5.0%, and the molten aluminum corrosion resistance and the high-temperature oxidation resistance of the thermal spray coating film may become insufficient. If the content of the second boride exceeds 15% by mass, the content of B in the thermal spray coating film may exceed 7.0% by mass. In this case, if the thermal spray coating film is used for a long period of time in a molten metal at a high temperature, boride in an excessive amount may be generated in the thermal spray coating film, so that the hardness of the thermal spray coating film may abnormally increase and the toughness may decrease. As a result, cracks may tend to occur in the thermal spray coating film, and dissolved loss of the material due to infiltration of molten aluminum and peeling of the thermal spray coating film may occur. When cracks occur in the thermal spray coating film, the area brought into contact with air increases, and as a result, the high-temperature oxidation resistance may become insufficient.

The present inventors evaluated the molten aluminum corrosion resistance and the high-temperature oxidation resistance of the undercoat layer 133*a* formed only of the second boride, but failed to obtain favorable results. Thus, the present inventors have found that excellent molten aluminum corrosion resistance and high-temperature oxidation resistance cannot be obtained unless the undercoat layer 133*a* is formed by combining the first boride and the second boride. This issue will be clarified in Examples to be described later.

As the Co-based alloy, for example, an alloy composed of Cr: 15% by mass or more and 35% by mass or less, W: 10% by mass or less, Fe: 7% by mass or less, C: less than 2% by mass, Ni: less than 5% by mass, and Co as the balance can be used.

If the Co-based alloy contains 5% by mass or more of Ni, Ni may be dissolved in the molten aluminum, in other words, the Co-based alloy as the binder metal may be dissolved in the molten aluminum, and the topcoat layer 133*b* having excellent abrasion resistance may be detached from the base material. Therefore, the Co-based alloy must not contain Ni in an amount of 5% by mass or more.

The undercoat layer 133*a* can be formed by, for example, thermally spraying a thermal spray material containing WB; at least one kind of $CrB_2$, $ZrB_2$, and $TiB_2$; and the Co-based alloy. As the Co-based alloy, a Co-based alloy composed of Cr and at least one kind of W and Fe can be used. The Co-based alloy may contain Ni, but the content of Ni must be less than 5% by mass. The undercoat layer 133*a* can be formed by setting the blending ratios of the above-mentioned thermal spray materials to appropriate values and thermally spraying the materials onto the surface of the base material of the roll body portion 131 by a high velocity flame spraying method (high velocity oxy-fuel: HVOF). The high-velocity flame spraying method is a kind of flame spraying method using a high-pressure oxygen and a combustion flame such as a hydrocarbon fuel gas, and a high-velocity flame comparable to that in the detonation flame spraying method can be generated by increasing the pressure of the combustion chamber. The coating film structure of the undercoat layer 133*a* can be densified by performing thermal spraying by a high-velocity flame spraying method. As a result, the number of through pores in the thermal spray coating film becomes extremely small, and penetration of molten metal into the thermal spray coating film can be suppressed.

When heat is applied during thermal spraying, part of WB reacts with Co contained in the Co-based alloy to form WCoB and $W_2CoB_2$. A small amount of W boride composed of W, Cr, and B may be formed. $CrB_2$ is partially converted into CrB by receiving heat at the time of thermal spraying. $ZrB_2$ is partially converted into ZrB by receiving heat at the time of thermal spraying. $TiB_2$ is partially converted into TiB by receiving heat at the time of thermal spraying. That is, when $CrB_2$ is thermally sprayed, the undercoat layer 133*a* includes CrB and $CrB_2$. When $ZrB_2$ is thermally sprayed, the undercoat layer 133*a* includes ZrB and $ZrB_2$. When $TiB_2$ is thermally sprayed, the undercoat layer 133*a* includes TiB and $TiB_2$.

(Topcoat Layer 133*b*)

Since the undercoat layer 133*a* has insufficient abrasion resistance, abrasion occurs due to the passing plate for a long period of time. Therefore, the topcoat layer 133*b* having excellent abrasion resistance is formed on the undercoat layer 133*a*.

The thermal spray coating film forming the topcoat layer 133*b* is a ceramic thermal spray coating film containing at least $ZrO_2$ and $Y_2O_3$. This ceramic thermal spray coating film is excellent in corrosion resistance against molten aluminum, has low hardness reduction at high temperature, and hardly causes abrasion even if it is exposed to molten aluminum environment for a long period of time. The preferable content of $Y_2O_3$ is 6% by mass or more and 12% by mass or less with respect to 100% by mass of the whole ceramic thermal spray coating film. When the content falls within the aforementioned composition range, the fracture toughness is high, so that the coating can withstand the thermal shock due to the rapid heating and quenching when immersed in molten aluminum.

Ceramic particles which are hard to react with molten aluminum (in other words, ceramic particles having thermodynamic properties equal to or higher than those of $ZrO_2$) may also be added. Specifically, at least one kind of CaO, $Al_2O_3$, $SiO_2$, and MgO can be used as the ceramic particles.

The topcoat layer 133*b* can be formed by thermally spraying a thermal spray powder containing, for example, $ZrO_2$ and $Y_2O_3$ onto the undercoat layer 133*a* by a plasma spraying method. The thermal spray powder may be allowed to contain the ceramic particles described above. The plasma spraying method is a method of using high-temperature and high-velocity plasma as a heat source for thermal spraying, where the high-temperature and high-velocity plasma is generated when discharge is performed between a pair of electrodes while an inert gas is allowed to flow. In general, argon is used as the working gas, and a water-cooled nozzle-like copper anode and a tungsten cathode are used as the electrodes. When an arc is generated between the electrodes, the working gas is converted into plasma by the arc, so that high-temperature and high-velocity plasma jet is ejected from the nozzle. By injecting the thermal spray powder into the plasma jet to heat and accelerate it, the thermal spray powder can be caused to collide with the undercoat layer 133*a* to form the topcoat layer 133*b*. According to the plasma spraying method, even a high melting point thermal spray material such as a $ZrO_2$-based material can be deposited.

(Friction Reducing Layer 133*c*)

Since the ceramic thermal spray coating film has a high melting point and is formed by plasma spraying, pores and cracks tend to occur in the thermal spray coating film. Therefore, there is a problem that molten aluminum easily infiltrates and penetrates the ceramic thermal spray coating film. In addition, the difference between the passing speed of the steel plate A and the rotating speed of the sink roll 13 increases the friction applied to the ceramic thermal spray coating film, so that problems such as damage and skin roughness tend to occur in the ceramic thermal spray coating film.

In order to avoid the above-mentioned problems, the friction reducing layer 133*c* is formed on the topcoat layer 133*b*. The friction reducing layer 133*c* includes BN and a specific oxide which hardly reacts with molten aluminum under a temperature condition of room temperature to 800° C. As the specific oxide, for example, one or more kinds of $TiO_2$, $ZrO_2$, $SiO_2$, MgO, and CaO can be used. The content of BN is 20% by mass or more with respect to 100% by mass of the friction reducing layer 133*c*. The upper limit value of BN is not particularly defined, but is preferably 50% by mass. If BN exceeds 50% by mass, the durability of the friction reducing layer 133*c* may be lowered. Use of the friction reducing material containing BN can form the friction reducing layer 133*c* having a slip lubricating property imparted to the surface of the ceramic thermal spray coating film.

The frictional force applied to the ceramic thermal spray coating film is thereby reduced, and damage, skin roughness, and the like of the ceramic thermal spray coating film can be suppressed. The friction reducing layer 133*c* can be formed by applying water containing a friction reducing material described above to the topcoat layer 133*b* and firing it.

The present inventors have also investigated the use of other nitrides such as TiN, ZrN, VN and the like as the friction reducing material, but have found that excellent high-temperature lubricity cannot be obtained unless BN is used. That is, the present inventors have found that the formation of the friction reducing layer 133*c* using a friction reducing material containing 20% by mass or more of BN reduces the frictional force applied to the ceramic thermal spray coating film more effectively. Specifically, the present inventors have found that even if the conveying speed of the steel sheet A reaches twice the conveying speed of the rolls, the rolls can be used for a long period of time. Note that the sink roll 13 is generally controlled at a speed lower than the conveying speed of the steel sheet A (that is, the line speed).

The friction reducing material preferably contains no chromium (e.g., chromic anhydride, ammonium chromate, ammonium dichromate) in the raw material. When chromium is contained in the raw material, part of the friction reducing material becomes chromium oxide after firing. This chromium oxide is more thermodynamically unstable than aluminum oxide and is susceptible to reduction by molten aluminum in a metal bath.

CaO is more thermodynamically stable than $Al_2O_3$. When CaO is used in combination with BN, the durability of the friction reducing layer 133*c* becomes longer.

Although the aforementioned embodiment has described the protective layer 133 of the sink roll 13, the protective layer 133 of the present invention can also be applied to the support roll 14. The speed of the support roll 14 is controlled to be lower than the line speed of the steel sheet A in order to absorb the influence of the vibration generated when the steel sheet A is conveyed. Specifically, in the case of the support roll 14, since the rotation speed thereof is controlled to be lower than that of the sink roll 13, the abrasion problem due to the speed difference becomes more remarkable. The invention of this application can thus be more suitably used for the support roll 14.

A more specific description will next be given of the present invention by way of Examples.

Example 1

In order to confirm the molten aluminum corrosion resistance of the undercoat layer, the following molten aluminum corrosion resistance experiment and high-temperature oxidation resistance test were performed. A thermally sprayed round bar sample having a thermal spray coating film formed on an Fe-base was prepared, immersed in a metal bath for 48 (hour), and then pulled out. The appearance and cross-sectional structure of the thermally sprayed round bar sample were observed. The bath component of the metal bath was 100% aluminum and the bath temperature was set at 700 (° C.)

Figure 4:
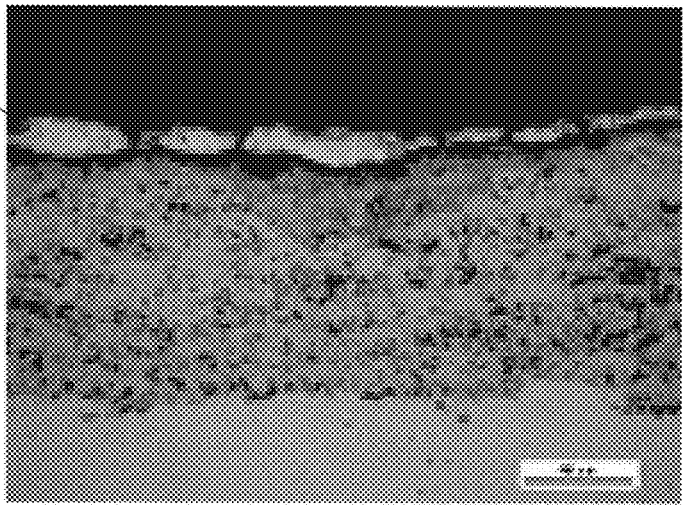
FIG. 4 is a magnified photograph showing a cross-sectional structure of a thermally sprayed round bar sample (where aluminum corrosion was hardly confirmed).
Figure 5:
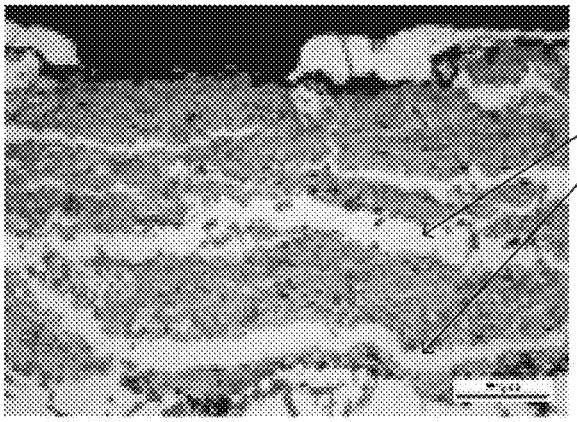
FIG. 5 is a magnified photograph showing a cross-sectional structure of a thermally sprayed round bar sample (where aluminum corrosion was confirmed).

When the corrosion by aluminum was hardly confirmed (for example, see FIG. 4), the molten aluminum corrosion resistance was evaluated as extremely good and the evaluation "very good" was assigned. When slight corrosion by aluminum was confirmed, the molten aluminum corrosion resistance was evaluated as generally good and the evaluation "good" was assigned. When a large amount of corrosion by aluminum was confirmed (for example, see FIG. 5), the molten aluminum corrosion resistance was evaluated as poor and the evaluation "poor" was assigned.

In the high-temperature oxidation resistance test, a test piece on which a thermal spray coating film had been formed was produced, and the test piece was heated by a thermogravimetric analyzer (TG) to obtain information on a change in weight, thereby evaluating oxidation resistance performance up to 600° C. in the air. The reason for setting the temperature to 600° C. is that the sink roll is preheated before being immersed in the metal bath 12, and the highest temperature of this preheating temperature is about 600° C.

Evaluation results of molten aluminum corrosion resistance and high-temperature oxidation resistance are shown in Tables 1 and 2. Note that any of Alloy 1, Alloy 2, Alloy 3, and Alloy 4 was used as the Co-based alloy, where Alloy 1 was composed of Cr: 35% by mass, W: 5% by mass, Fe: 2% by mass, C: less than 2% by mass, and Co as the balance; Alloy 2 was composed of Cr: 25% by mass, W: 10% by mass, Fe: 1.5% by mass, C: less than 2% by mass, Ni: 1.0% by mass, and Co as the balance; Alloy 3 was composed of Cr: 20% by mass, W: 5% by mass, C: 1.0% by mass, Ni: 2.0% by mass, and Co as the balance; and Alloy 4 was composed of Cr: 15% by mass, Fe: 7% by mass, C: 1.3% by mass, Ni: 3.0% by mass, and Co as the balance.

TABLE 1

| Sample No. | First Boride | Second Boride | Content of B | Co-based Alloy | Corrosion Resistance | High-temperature Oxidation Resistance | |
|---|---|---|---|---|---|---|---|
| 1 | W Boride: 56% by mass | Cr Boride: 10% by mass | 6.0% by mass | Alloy 1 | good | good | Example |
| 2 | W Boride: 58% by mass | Zr Boride: 11% by mass | 5.3% by mass | Alloy 1 | very good | very good | Example |
| 3 | W Boride: 58% by mass | Ti Boride: 10% by mass | 5.1% by mass | Alloy 1 | good | good | Example |
| 4 | W Boride: 72% by mass | Cr Boride: 10% by mass | 5.7% by mass | Alloy 2 | good | good | Example |
| 5 | W Boride: 73% by mass | Zr Boride: 11% by mass | 6.2% by mass | Alloy 2 | very good | very good | Example |
| 6 | W Boride: 73% by mass | Ti Boride: 10% by mass | 5.9% by mass | Alloy 2 | good | good | Example |
| 7 | W Boride: 52% by mass | Cr Boride: 10% by mass | 4.6% by mass | Alloy 3 | poor | poor | Comparative Example |
| 8 | W Boride: 52% by mass | Zr Boride: 11% by mass | 4.1% by mass | Alloy 3 | poor | poor | Comparative Example |
| 9 | W Boride: 78% by mass | Cr Boride: 10% by mass | 7.3% by mass | Alloy 3 | poor | poor | Comparative Example |
| 10 | W Boride: 78% by mass | Zr Boride: 11% by mass | 7.8% by mass | Alloy 3 | poor | poor | Comparative Example |
| 11 | W Boride: 68% by mass | Cr Boride: 6% by mass | 5.5% by mass | Alloy 4 | good | very good | Example |
| 12 | W Boride: 68% by mass | Zr Boride: 6% by mass | 4.9% by mass | Alloy 3 | good | very good | Example |
| 13 | W Boride: 68% by mass | Ti Boride: 5% by mass | 5.3% by mass | Alloy 2 | good | very good | Example |

TABLE 1-continued

| Sample No. | First Boride | Second Boride | Content of B | Co-based Alloy | Corrosion Resistance | High-temperature Oxidation Resistance | |
|---|---|---|---|---|---|---|---|
| 14 | W Boride: 68% by mass | Cr Boride: 13% by mass | 6.0% by mass | Alloy 1 | good | very good | Example |
| 15 | W Boride: 68% by mass | Zr Boride: 14% by mass | 5.3% by mass | Alloy 2 | good | very good | Example |
| 16 | W Boride: 68% by mass | Ti Boride: 13% by mass | 6.2% by mass | Alloy 3 | good | very good | Example |
| 17 | W Boride: 68% by mass | Cr Boride: 4% by mass | 4.5% by mass | Alloy 1 | poor | poor | Comparative Example |
| 18 | W Boride: 68% by mass | Zr Boride: 4% by mass | 4.2% by mass | Alloy 2 | poor | poor | Comparative Example |
| 19 | W Boride: 68% by mass | Ti Boride: 4% by mass | 4.5% by mass | Alloy 3 | poor | poor | Comparative Example |
| 20 | W Boride: 68% by mass | Cr Boride: 16% by mass | 8.5% by mass | Alloy 1 | poor | poor | Comparative Example |
| 21 | W Boride: 68% by mass | Zr Boride: 17% by mass | 7.1% by mass | Alloy 2 | poor | poor | Comparative Example |
| 22 | W Boride: 68% by mass | Ti Boride: 16% by mass | 8.8% by mass | Alloy 3 | poor | poor | Comparative Example |
| 23 | W Boride: 64% by mass | Cr Boride: 8% by mass | 5.9% by mass | Alloy 1 | very good | very good | Example |
| 24 | W Boride: 69% by mass | Zr Boride: 9% by mass | 5.6% by mass | Alloy 4 | very good | very good | Example |
| 25 | W Boride: 70% by mass | Ti Boride: 12% by mass | 6.1% by mass | Alloy 4 | very good | very good | Example |

TABLE 2

| Sample No. | First Boride | Second Boride | Co-based Alloy | Corrosion Resistance | High-temperature Oxidation Resistance | |
|---|---|---|---|---|---|---|
| 26 | | Cr Boride: 28% by mass<br>Zr Boride: 42% by mass | Alloy 1 | poor | poor | Comparative Example |
| 27 | | Cr Boride: 30% by mass<br>Zr Boride: 45% by mass | Alloy 1 | poor | poor | Comparative Example |
| 28 | | Cr Boride: 35% by mass<br>Ti Boride: 32% by mass | Alloy 2 | poor | poor | Comparative Example |
| 29 | | Cr Boride: 42% by mass<br>Ti Boride: 34% by mass | Alloy 2 | poor | poor | Comparative Example |
| 30 | | Zr Boride: 35% by mass<br>Ti Boride: 34% by mass | Alloy 4 | poor | poor | Comparative Example |
| 31 | | Zr Boride: 40% by mass<br>Ti Boride: 38% by mass | Alloy 4 | poor | poor | Comparative Example |

From the test results, it was found that when the content of the first boride was 55% by mass or more and 75% by mass or less and the content of the second boride was 5% by mass or more and 15% by mass or less in the undercoat layer formed, corrosion resistance to molten aluminum and high-temperature oxidation resistance were simultaneously imparted thereto. In particular, it was found that when the content of the first boride was 64% by mass or more and 70% by mass or less and the content of the second boride was 7% by mass or more and 12% by mass or less, the above-mentioned effects were remarkably increased. From the results of Sample Nos. 1 to 6, it was found that the combination of W boride and Zr boride was particularly excellent. On the contrary, it was found that the thermal spray coating film in which only the second boride is combined had lower corrosion resistance to molten aluminum and lower high-temperature oxidation resistance than the thermal spray coating film of the invention of this application. The first boride (W boride) is composed of WB, WCoB, and $W_2CoB_2$ and the total content of these borides is listed in Table 1. The total content of CrB and $CrB_2$ is described as the content of Cr boride, the total content of ZrB and $ZrB_2$ is described as the content of Zr boride, and the total content of TiB and $TiB_2$ is described as the content of Ti boride.

Example 2

The Co-based alloy of Sample Nos. 23 to 25 in Table 1 was changed to a Co-based alloy 5 composed of Cr: 15% by mass, Fe: 7% by mass, C: 1.0% by mass, Ni: 5.5% by mass, and Co as the balance (i.e., a Co-based alloy having a large amount of Ni), and the corrosion resistance against molten aluminum was examined in the same manner as described above. The molten aluminum used was the same as that in Example 1. The results are shown in Table 3.

TABLE 3

| Sample No. | First Boride | Second Boride | Co-based Alloy | Peeling Resistance | |
|---|---|---|---|---|---|
| 32 | W Boride: 64% by mass | Cr Boride: 8% by mass | Alloy 5 | poor | Comparative Example |
| 33 | W Boride: 69% by mass | Zr Boride: 9% by mass | Alloy 5 | poor | Comparative Example |
| 34 | W Boride: 70% by mass | Ti Boride: 12% by mass | Alloy 5 | poor | Comparative Example |

From the test results described above, it was found that when the content of Ni in the Co-based alloy exceeded 5% by mass, the thermal spray coating film was corroded by molten aluminum.

Example 3

Figure 6:
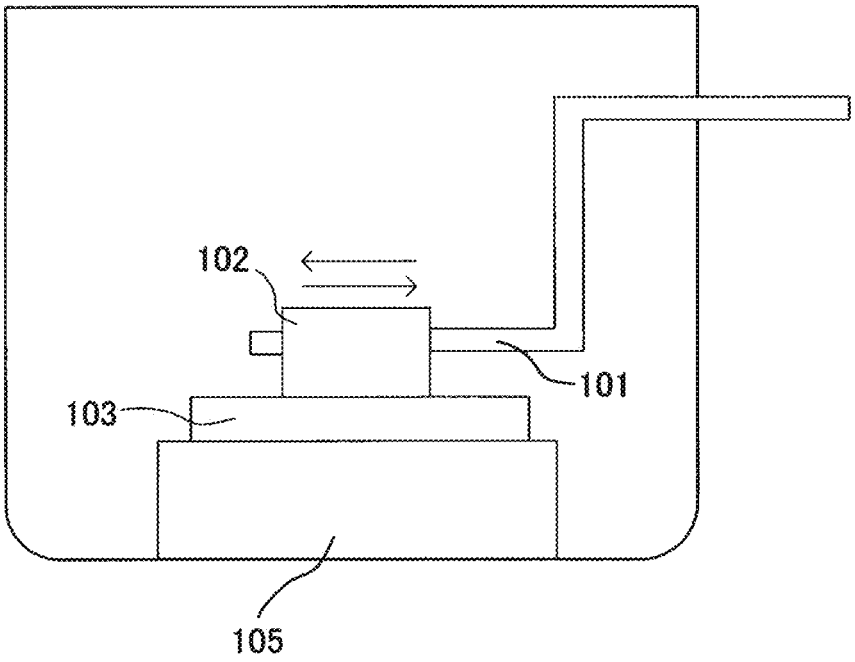
FIG. 6 is a schematic view illustrating an abrasion test apparatus (with a metal bath).

The abrasion resistance of the topcoat layer was confirmed by the abrasion test apparatus of FIG. 6. In the figure, reference numeral 101 denotes a sliding shaft bent in two stages, and an evaluation member 102 extending in a plate shape was attached to a distal end portion of the sliding shaft 101. As a base material of the evaluation member 102, SUS304 was used. An undercoat layer and a topcoat layer were formed on the surface of the base material of the evaluation member 102. The undercoat layer was composed of a thermal spray coating layer of Sample No. 23 of Example 1. While a mating member 103 supported by a support member 105 was pressed against the evaluation member 102 with a predetermined load, the sliding shaft 101 was reciprocated for 48 (hour) horizontally as indicated by an arrow. The pressing load was set to 5.0 (kgf). The sliding speed of the sliding shaft 101 was set to 50 (mm/s). The mating member 103 was composed of SUS304.

The composition of the topcoat layer was variously changed, and the above-mentioned evaluation using the actual machine was carried out for each of the evaluation members. After the test, each evaluation member 102 was cut, and the cross-sectional structure of the cut surface was observed to confirm the change in the film thickness of the topcoat layer. When the thickness of the topcoat layer before the test was assumed to be 100% and the thickness reduction ratio after the test was 50% or more, the abrasion resistance was evaluated as low and the evaluation "poor" was assigned. When the thickness reduction ratio after the test was less than 50%, the abrasion resistance was evaluated as high and the evaluation "good" was assigned. Table 4 shows the test results.

TABLE 4

| Sample No. | Composition of Topcoat Layer | Added Particles | Abrasion Resistance |
|---|---|---|---|
| 35 | $ZrO_2$: 94% by mass<br>$Y_2O_3$: 6% by mass | None | good |
| 36 | ZrO2: 88% by mass<br>$Y_2O_3$: 12% by mass | None | good |
| 37 | ZrO2: 90% by mass<br>$Y_2O_3$: 6% by mass | $SiO_2$: 4% by mass | good |
| 38 | ZrO2: 91% by mass<br>$Y_2O_3$: 7% by mass | CaO: 2% by mass | good |
| 39 | ZrO2: 96% by mass<br>$Y_2O_3$: 4% by mass | None | poor |
| 40 | ZrO2: 86% by mass<br>$Y_2O_3$: 14% by mass | None | poor |

In this example, when $Y_2O_3$ was outside the desired numerical range, the evaluation of the abrasion resistance was decreased to "poor". However, since the friction reducing layer having excellent abrasion resistance is formed on the topcoat layer, even a topcoat layer having relatively low abrasion resistance like Sample Nos. 39 and 40 is encompassed by the scope of the present invention.

Example 4

Sample Nos. 35 to 40 described above were each immersed in a metal bath to confirm the molten aluminum corrosion resistance of the topcoat layer. The bath component of the metal bath was 100% by weight of aluminum, the bath temperature was set to 700 (° C.), and the immersion time was set to 48 (hour). Appearance observation was performed after the immersion test. When dissolved loss was found in the topcoat layer or cracks were generated in the topcoat layer and the dissolved loss was found in the base material due to molten aluminum infiltrating from the cracks, the molten aluminum corrosion resistance was evaluated as low and the evaluation "poor" was assigned. When no dissolved loss was found, the molten aluminum corrosion resistance was evaluated as high and the evaluation "good" was assigned.

TABLE 5

| Sample No. | Composition of Topcoat Layer | Added Particles | Abrasion Resistance |
|---|---|---|---|
| 35 | ZrO2: 94% by mass<br>$Y_2O_3$: 6% by mass | None | good |
| 36 | ZrO2: 88% by mass<br>$Y_2O_3$: 12% by mass | None | good |
| 37 | ZrO2: 90% by mass<br>$Y_2O_3$: 6% by mass | $SiO_2$: 4% by mass | good |
| 38 | ZrO2: 91% by mass<br>$Y_2O_3$: 7% by mass | CaO: 2% by mass | good |
| 39 | ZrO2: 96% by mass<br>$Y_2O_3$: 4% by mass | None | poor |
| 40 | ZrO2: 86% by mass<br>$Y_2O_3$: 14% by mass | None | poor |

In the present embodiment, when $Y_2O_3$ was outside the desired numerical range, the evaluation of the corrosion resistance was decreased to "poor". However, since the friction reducing layer is formed on the topcoat layer, even a topcoat layer having relatively low corrosion resistance like Sample Nos. 39 and 40 is encompassed by the scope of the present invention.

Example 5

Figure 7:
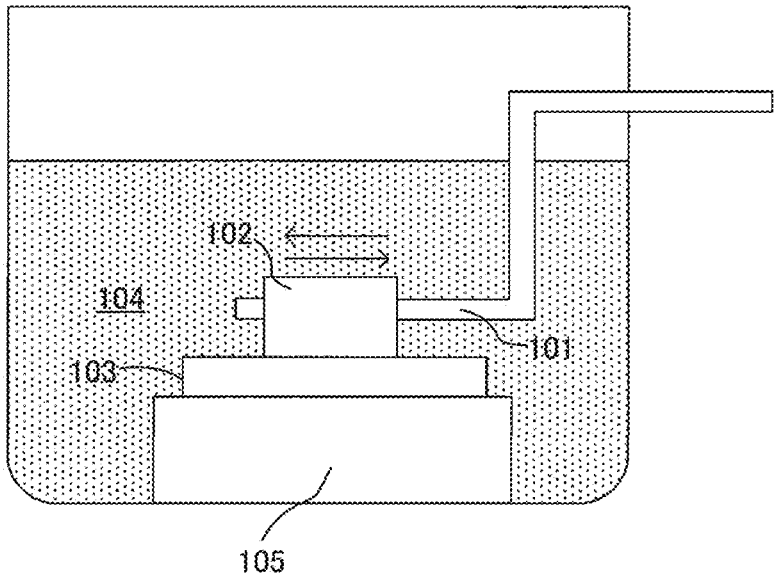
FIG. 7 is a schematic view illustrating an abrasion test apparatus (without a metal bath).

The friction reducing effect of the friction reducing layer was confirmed by the abrasion test apparatus of FIG. 7. Components common in function to those in the abrasion test apparatus of FIG. 6 are denoted by the same reference numerals. In the figure, reference numeral 104 denotes a metal bath, and a sliding shaft 101 bent in two stages was arranged in the metal bath 104. An evaluation member 102 extending in a plate shape was attached to a distal end portion of the sliding shaft 101. While a mating member 103 supported by a support member 105 was pressed against the evaluation member 102 in the metal bath 104 with a predetermined load, the sliding shaft 101 was reciprocated for 48 (hour) horizontally as indicated by an arrow. The bath component of the metal bath 104 was 100% by mass of aluminum, and the bath temperature was set to 700 (° C.). The pressing load was set to 5.0 (kgf). The sliding speed of the sliding shaft 101 was set to 50 (mm/s). The mating member 103 was composed of SUS304.

An undercoat layer and a topcoat layer were formed on the surface of the evaluation member 102, and a friction reducing layer was formed on the topcoat layer. The undercoat layer was formed by the thermal spray coating film of Sample No. 23 of Example 1. The topcoat layer was formed by the thermal spray coating film of Sample No. 35 of Example 3. The composition of the friction reducing layer was variously changed, and the abrasion resistance test was carried out for each of the evaluation members. After the abrasion test, each evaluation member 102 was cut, and the cut surface was observed. When the thickness of the topcoat layer before the test was assumed to be 100% and the thickness reduction ratio after the test was 20% or more, the abrasion resistance was evaluated as poor and the evaluation "poor" was assigned. When the thickness reduction ratio after the test was less than 20%, the abrasion resistance was evaluated as good and the evaluation "good" was assigned. When there was no change in the thickness of the topcoat layer and the friction reducing layer remained, the abrasion resistance was evaluated as very good and the evaluation "very good" was assigned.

TABLE 6

| Sample No. | Composition of Friction Reducing Layer | High-temperature Abrasion Resistance | |
|---|---|---|---|
| 41 | BN: 20% by mass<br>$TiO_2$: 80% by mass | good | Example |
| 42 | BN: 35% by mass<br>$TiO_2$: 65% by mass | good | Example |
| 43 | BN: 17% by mass<br>$TiO_2$: 83% by mass | poor | Comparative Example |
| 44 | BN: 21% by mass<br>$ZrO_2$: 79% by mass | good | Example |
| 45 | BN: 38% by mass<br>$ZrO_2$: 62% by mass | good | Example |
| 46 | BN: 16% by mass<br>ZrO2: 84% by mass | poor | Comparative Example |
| 47 | BN: 20% by mass<br>$SiO_2$: 80% by mass | good | Example |
| 48 | BN: 41% by mass<br>$SiO_2$: 59% by mass | good | Example |
| 49 | BN: 16% by mass<br>$SiO_2$: 84% by mass | poor | Comparative Example |
| 50 | BN: 21% by mass<br>MgO: 79% by mass | good | Example |
| 51 | BN: 28% by mass<br>MgO: 72% by mass | good | Example |
| 52 | BN: 16% by mass<br>MgO: 84% by mass | poor | Comparative Example |
| 53 | BN: 20% by mass<br>CaO: 80% by mass | very good | Example |
| 54 | BN: 34% by mass<br>CaO: 66% by mass | very good | Example |
| 55 | BN: 16% by mass<br>CaO: 84% by mass | poor | Comparative Example |
| 56 | TiN: 20% by mass<br>$TiO_2$: 80% by mass | poor | Comparative Example |
| 57 | ZrN: 21% by mass<br>ZrO2: 79% by mass | poor | Comparative Example |
| 58 | VN: 20% by mass<br>$SiO_2$: 80% by mass | poor | Comparative Example |

From the above-described results, it was found that BN was particularly excellent among nitrides in terms of high temperature abrasion resistance. In order to exert excellent high-temperature abrasion resistance, it was found that 20% by mass or more of BN contained in the friction reducing layer is necessary. In particular, it was found that the abrasion resistance is drastically increased by forming the friction reducing layer from BN and CaO.

The invention claimed is:

1. An in-bath roll used in a metal bath containing at least 50% by mass or more of Al, the in-bath roll comprising:

an undercoat layer formed on a surface of the roll, the undercoat layer being formed by a cermet thermal spray coating film containing a first boride containing at least WB, WCoB, $W_2CoB_2$, a second boride composed of at least one kind of Cr, Zr, and Ti borides, and a balance composed of a cobalt-based alloy not containing nickel of 5% by mass or more;

a topcoat layer formed on a surface of the undercoat layer, the topcoat layer being formed by a ceramic thermal spray coating film containing at least $ZrO_2$ and $Y_2O_3$; and a friction reducing layer formed on a surface of the topcoat layer, the friction reducing layer being composed of BN and at least one kind of $TiO_2$, $ZrO_2$, $SiO_2$, MgO, and CaO, wherein with respect to 100% by mass of the cermet thermal spray coating film, the first boride is 55% by mass or more and 75% by mass or less, the second boride is 5% by mass or more and 15% by mass or less, and a content of B is 5.0% by mass or more and 7.0% by mass or less, and BN is contained in an amount of 20% by mass or more with respect to 100% by mass of the friction reducing layer.

2. The in-bath roll according to claim 1, wherein, with respect to 100% by mass of the cermet thermal spray coating film, a content of the first boride is 64% by mass or more and 70% by mass or less and a content of the second boride is 7% by mass or more and 12% by mass or less.

3. The in-bath roll according to claim 2, wherein the ceramic thermal spray coating film further contains at least one kind of CaO, $Al_2O_3$, $SiO_2$, and MgO.

4. The in-bath roll according to claim 2, wherein, with respect to 100% by mass of the ceramic thermal spray coating film, $Y_2O_3$ is contained in an amount of 6% by mass or more and 12% by mass or less.

5. The in-bath roll according to claim 1, wherein, with respect to 100% by mass of the ceramic thermal spray coating film, $Y_2O_3$ is contained in an amount of 6% by mass or more and 12% by mass or less.

6. The in-bath roll according to claim 5, wherein the ceramic thermal spray coating film further contains at least one kind of CaO, $Al_2O_3$, $SiO_2$, and MgO.

7. The in-bath roll according to claim 1, wherein the ceramic thermal spray coating film further contains at least one kind of CaO, $Al_2O_3$, $SiO_2$, and MgO.

8. A method for producing the in-bath roll according to claim 1, comprising:

forming the cermet thermal spray coating film by a high velocity flame spraying method; and forming the ceramic thermal spray coating film by a plasma spraying method.

9. The method for producing the in-bath roll according to claim 8, wherein the friction reducing layer is formed by coating the topcoat layer with water containing BN and at least one kind of $TiO_2$, $ZrO_2$, $SiO_2$, MgO, and CaO, followed by firing.

* * * * *